US011235955B2

(12) United States Patent
Kaufhold et al.

(10) Patent No.: US 11,235,955 B2
(45) Date of Patent: Feb. 1, 2022

(54) MONITORED ESCALATOR BARRICADE SYSTEM

(71) Applicants: Steven Kaufhold, Valley City, OH (US); Julie A. Kaufhold, Valley City, OH (US)

(72) Inventors: Steven Kaufhold, Valley City, OH (US); Julie A. Kaufhold, Valley City, OH (US)

( * ) Notice: Subject to any disclaimer, the term of this patent is extended or adjusted under 35 U.S.C. 154(b) by 0 days.

(21) Appl. No.: 16/882,441

(22) Filed: May 23, 2020

(65) Prior Publication Data

US 2021/0362982 A1 Nov. 25, 2021

(51) Int. Cl.

| | |
|---|---|
| ***B66B 29/00*** | (2006.01) |
| ***G08B 3/10*** | (2006.01) |
| ***G08B 13/08*** | (2006.01) |
| ***E05F 1/12*** | (2006.01) |

(52) U.S. Cl.

CPC ..... *B66B 29/005* (2013.01); *E05F 1/12* (2013.01); *G08B 3/10* (2013.01); *G08B 13/08* (2013.01)

(58) Field of Classification Search

CPC ..... B66B 29/005; E05F 1/12; G08B 3/10; G08B 13/08

USPC ..... 49/13

See application file for complete search history.

(56) References Cited

U.S. PATENT DOCUMENTS

| | | | | |
|---|---|---|---|---|
| 5,923,005 | A * | 7/1999 | Blondiau | B66B 25/00 187/392 |
| 6,334,522 | B2 * | 1/2002 | Haruta | B66B 25/00 198/322 |
| 7,453,358 | B2 * | 11/2008 | Webster | B65G 19/02 104/172.3 |
| 7,931,136 | B2 * | 4/2011 | Webster | B66B 29/005 198/323 |
| 2010/0018087 | A1 * | 1/2010 | Erickson | G09F 19/22 40/1 |

* cited by examiner

*Primary Examiner* — John A Tweel, Jr.

(57) ABSTRACT

A monitored escalator barricade system is disclosed herein having a barricade assembly including a hosting column supporting a one-way swinging door and a magnetic locking mechanism. The barricade assembly is installable at a landing floor and allows for one-way passage of a user riding along an outer edge of an escalator in order to prevent injuries. The barricade assembly utilizes IR beam transmitters on an exterior of the hosting column to detect when a user arrives near the landing floor and unlock the one-way swinging door as the user approaches. The monitored escalator barricade system includes various visual and audio indicators for notifying authorities.

20 Claims, 5 Drawing Sheets

MONITORED ESCALATOR BARRICADE SYSTEM

BACKGROUND OF THE INVENTION

The following includes information that may be useful in understanding the present disclosure. It is not an admission that any of the information provided herein is prior art nor material to the presently described or claimed invention, nor that any publication or document that is specifically or implicitly referenced is prior art.

TECHNICAL FIELD

The present invention relates generally to the field of safety devices of existing art and more specifically relates to escalator barricades.

RELATED ART

Elevators are more common than escalators, move faster, and are used more frequently by many more people. Escalators have a much higher rate of passenger injuries and fatalities, though. This isn't because escalators are more dangerous in operation. It's because passengers have more opportunity to intentionally misuse them. Many hop over the balustrade to stand on the outer deck of escalators, continuing the ride up while only holding the moving handrail. When they arrive at the landing floor, though, they contact an immobile barricade. This can cause injuries, falls and even fatalities. A suitable means for preventing accidents is desired.

U.S. Pat. No. 8,079,515 to Wolfram Kocznar relates to an access control gate. The described access control gate includes an access control gate with a mechanical guide forming one or more access lanes for patrons. A contactless access reader which is connected to a software controlled verification system identifies access right of patrons shortly before the person approaches a gate threshold formed by two motor driven flaps which when closed protrude into the access lane from left and right of the lateral lane boundaries a verification system activates the flaps when an access right has been granted. Two or more photoelectric barriers detect the passage of patrons through the gate threshold, wherein the detecting beams are spaced apart by between 1 and 10 inches and directed to the lane zone behind the gate threshold. The flaps are closed after the patron has passed through.

SUMMARY OF THE INVENTION

In view of the foregoing disadvantages inherent in the known escalator barricades art, the present disclosure provides a novel monitored escalator barricade system. The general purpose of the present disclosure, which will be described subsequently in greater detail, is to provide an escalator barricade structure including a one-way pivoting door which allows for a user on an outer deck area of an escalator to continue moving to the landing floor instead of striking a solid, immobile barricade.

A monitored escalator barricade system is disclosed herein. The monitored escalator barricade system includes a barricade assembly which is installable on a landing floor near an escalator and projects perpendicular to an outer deck of the escalator. The barricade assembly includes a one-way swinging door allowing one-way passage of a user having a magnetized metal door-plate on an open vertical plane of the one-way swinging door, a hosting column supporting the one-way swinging door and housing a transceiver and including IR beam transmitters on an exterior of the hosting column configured to detect when the user arrives near the landing floor, a magnetized metal floor tab in alignment to and magnetically contacts to the magnetized metal door-plate, and an alarm system. The transceiver is electrically connected to the magnetized metal door-plate and the IR beam transmitters are electrically connected by wire to the transceiver. Interruption of the IR beam transmitters detected by the transceiver unlocks the one-way swinging door allowing for passage of the user. The alarm system is in communication with the transceiver and configured to activate after the one-way swinging door is opened. The alarm system comprises an audio speaker configured to output audio and at least one light emitting member. The alarm system may be able to sync with a security-officer-notification system of a using establishment.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a monitored escalator barricade system, constructed and operative according to the teachings of the present disclosure.

The various embodiments of the present invention will hereinafter be described in conjunction with the appended drawings, wherein like designations denote like elements.

DETAILED DESCRIPTION

Figure 1:
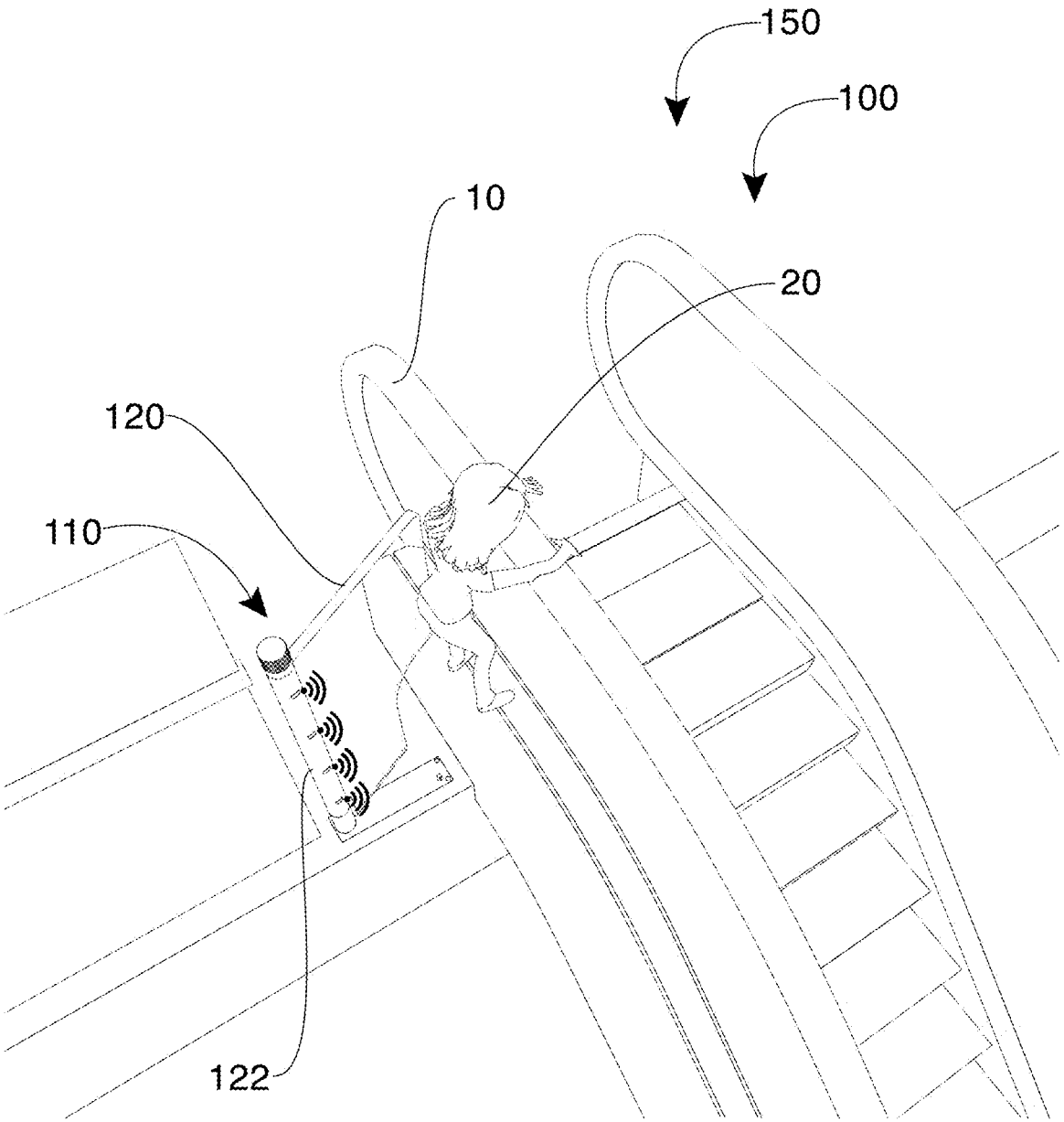
FIG. 1 is a perspective view of the monitored escalator barricade system during an 'in-use' condition, according to an embodiment of the disclosure.

As discussed above, embodiments of the present disclosure relate to escalator barricades and more particularly to a monitored escalator barricade system as used to prevent falls that commonly occur when persons attempt to ride the outer deck of an escalator, and avoid the damages, injuries, and fatalities that occur from such incidents. The monitored escalator barricade system may be installed at the top outside edge of an ascending escalator.

Generally, the monitored escalator barricade system is an escalator barricade structure, for placement on the landing floor of an ascending escalator near the outer deck area of the escalator, that includes a one-way swinging door which allows anyone on the outer deck area of an escalator to continue moving to the landing floor instead of striking a solid, immobile barricade. Spring-loaded, self-returning hinges are provided for attachment of the door to a door-hosting column. A magnetized metal plate is positioned on an open vertical plane of the door and a base plate including a magnetized metal floor tab is provided. The magnetized metal floor tab is in alignment to the magnetized metal plate of the door. The floor tab features a notification light that illuminates when the door is attached, and the system is active. The light does not illuminate if the door is not attached and/or the system is not active. A transceiver is featured within the door-hosting column and connected by wire to the metal plate attached to the door. IR beam transmitters are featured on an exterior portion of the door-hosting column and are attached by wire to the transceiver. After a user passes through the plexiglass door, the plexiglass door relocks to prevent wrong way passage from occurring. The monitored escalator barricade system further includes an alarm function and the function may sync with a using establishment's security-officer-notification system. The alarm of the monitored escalator barricade system immediately informs authorities in the area when its pivoting door is operated. The alarm system includes an audio speaker and an alarm light which are connected by wire to the transceiver and featured within the door-hosting column.

In a preferred embodiment, the one-way pivoting door includes a translucent plexiglass material. However, the door may include various materials, such as but not limited to glass, plexiglass, acrylic, and pipe and may or may not match the material(s) of the interior panel of the corresponding balustrade. The pivoting door of the monitored escalator barricade system allows exit from an outer deck through its escalator barricade to a landing floor, unlike standard, immobile escalator barricades. The pivoting door of the monitored escalator barricade system can only be opened when a person arrives near its facing, which interrupts the broadcasting infrared (IR) beam, which unlocks said pivoting door. The pivoting door of the monitored escalator barricade system automatically recloses after its opening, returning the structure to its barricade purpose. The pivoting door of the monitored escalator barricade system only pivots in one (1) direction, preventing re-entry to the outer deck of the escalator from a landing floor. The pivoting door of the monitored escalator barricade system relocks after closing, preventing it from being opened from the landing floor. The monitored escalator barricade system may be provided in various sizes and shapes to accommodate individual points of placement.

The monitored escalator barricade system can be made in various formats and with different mechanisms that allow its door to swing open towards a landing floor while still preventing the door from being opened from a landing floor. Such formats include but are not limited to: a crash bar on the interior plane of the monitored escalator barricade system and an infrared (IR) beam near the interior plane of the monitored escalator barricade system that will turn off a locking mechanism when said IR beam is interrupted. The alarm device of the monitored escalator barricade system may broadcast through an included audio speaker, and/or may send signal to communication devices used by facility authorities. The monitored escalator barricade system may or may not include an alarm device that sounds after its pivoting door is opened.

Should an escalator passenger travel upon the outer deck of an escalator, the infrared (IR) beam transmitter of the monitored escalator barricade system will detect when the passenger arrives near the landing floor. This interruption of the IR is detected by the transceiver, which then triggers opening of the one-way pivoting door allowing a user to safely move through the door. The audio alarm of the device is triggered following the opening of the one-way pivoting door. The hinge of the door then automatically retracts, closing the door. Upon that closing, the corresponding metal frame and tab resume magnetic attachment, thus preventing the door from being opened from the landing floor.

The monitored escalator barricade system can bear instructional signage, such as but not limited to "push," on its outer-deck facing plane, and said signage may be printed in multiple languages of relevance to its area of use. In further variation, said printed instruction(s) may be illuminated, and such illumination may be permanent or only when the monitored escalator barricade system detects a person is near its door. Additionally, the monitored escalator barricade system can include instructional and/or warning signage for posting at the landing floor near its point of placement, such as but not limited to "area must remain clear." Signage may be printed in multiple languages of relevance to its area of use.

The monitored escalator barricade system can be made in variations that include sensors or motion detectors for placement at various lengths of the escalator. The sensors may initiate alarm for notification to facility authorities, and/or to stop the escalator if presence on the outer deck is determined at a low height.

Referring now more specifically to the drawings by numerals of reference, there is shown in FIGS. 1-5, various views of a monitored escalator barricade system 100. FIG. 1 shows a monitored escalator barricade system during an 'in-use' condition 150, according to an embodiment of the present disclosure. As illustrated, the monitored escalator barricade system 100 may include barricade assembly 110 which is installable on a landing floor proximal to an escalator 10.

Figure 2:
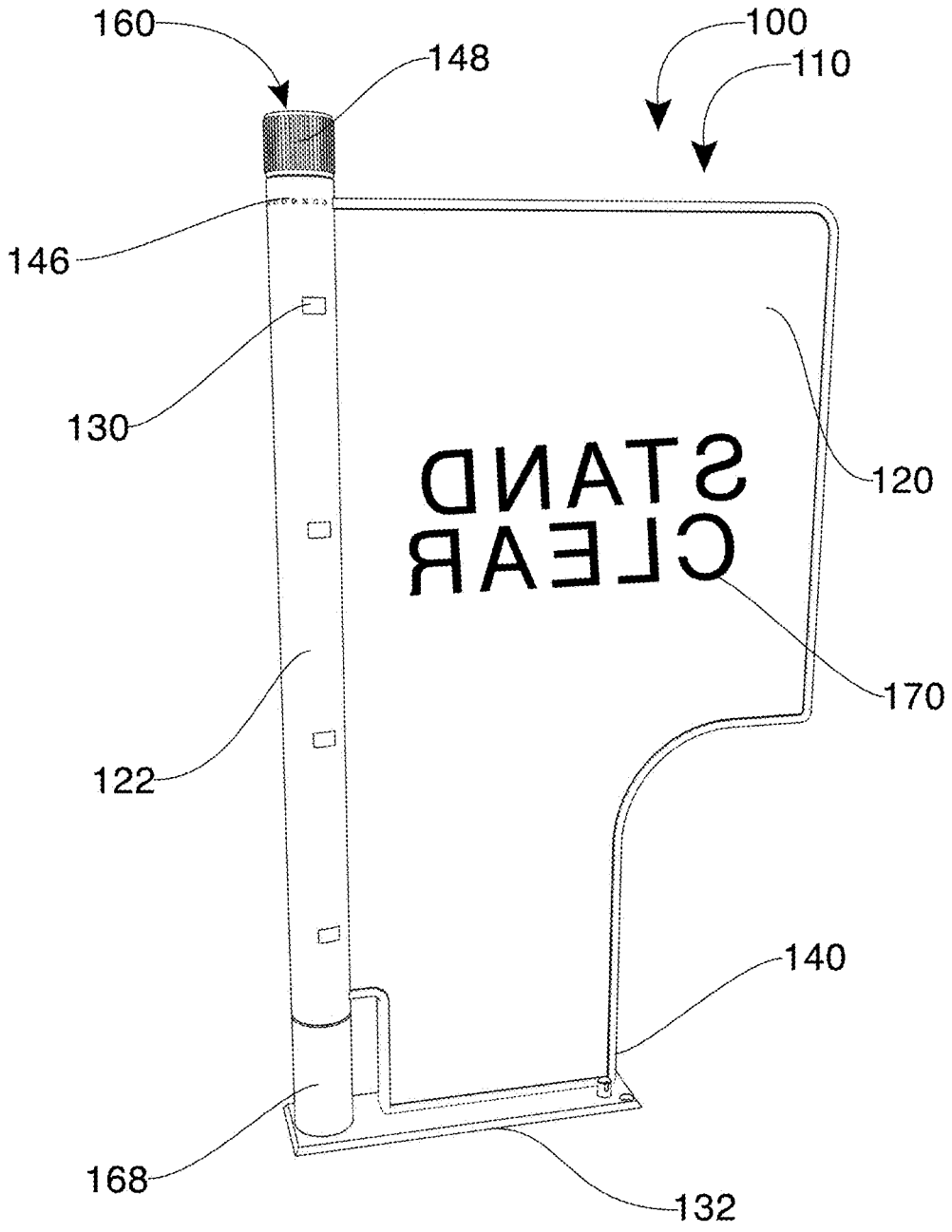
FIG. 2 is a perspective view of the monitored escalator barricade system of FIG. 1, including a barricade assembly having a one-way swinging door supported on a hosting column according to an embodiment of the present disclosure.

FIG. 2 shows the monitored escalator barricade system 100 of FIG. 1, according to an embodiment of the present disclosure. As above, the monitored escalator barricade system 100 may include the barricade assembly 110 including a one-way swinging door 120 allowing one-way passage of a user 20 having a magnetized metal door-plate 140 on an open vertical plane of the one-way swinging door 120, a hosting column 122 supporting the one-way swinging door 120 and housing a transceiver 126 and including IR beam transmitters 130 on an exterior of the hosting column 122 configured to detect when the user 20 arrives near the landing floor, a magnetized metal floor tab 142 in alignment to and magnetically contacts to the magnetized metal door-plate 140, and an alarm system 160. Contact between the magnetized metal door-plate 140 and the magnetized metal floor tab 142 provide a locking mechanism. The hosting column 122 is supported upon a base plate 132 and the base plate 132 is mountable to the landing floor. The alarm system 160 is in communication with the transceiver 126 and configured to activate when the door is pushed by the user 20 and to notify authorities. The transceiver 126 is electrically connected to the magnetized metal door-plate 140 and the IR beam transmitters 130 are electrically connected by wire to the transceiver 126.

The one-way swinging door 120 is attached to the hosting column 122 via fasteners 168. Preferably, the fasteners 168 comprise spring-loaded, self-returning hinges. The spring-loaded, self-returning hinges are limited to ninety-degree rotation. The alarm system 160 includes an audio speaker 146 configured to output audio and at least one light emitting member 148. The audio speaker 146 and the at least one light emitting member 148 are contained within, and project from, the hosting column 122 and connect by wire to the transceiver 126. The alarm system 160 is able to sync with a security-officer-notification system of a using establishment. Interruption the IR beam transmitters 130 detected by the transceiver 126 unlocks the one-way swinging door 120. The IR beam transmitters 130 are equidistantly spaced along a length of the exterior of the hosting column 122. The audio speaker 146 of the alarm system 160 is activated after the one-way swinging door 120 is opened.

Figure 3:
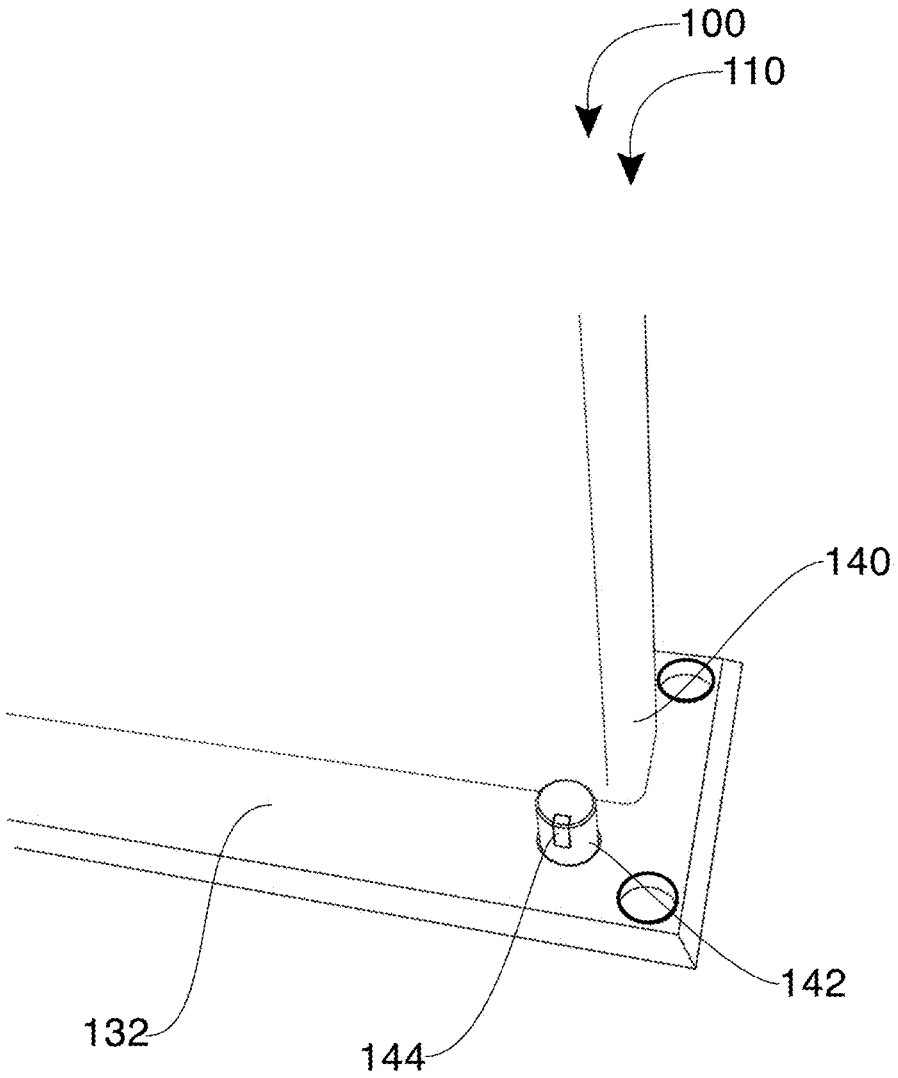
FIG. 3 is a perspective view of a base plate of the monitored escalator barricade system of FIG. 1, according to an embodiment of the present disclosure.

FIG. 3 is a perspective view of the monitored escalator barricade system 100 of FIG. 1, according to an embodiment of the present disclosure. As shown, the hosting column 122 may be supported upon the base plate 132. The one-way swinging door 120 automatically returns to a closed position after the user 20 passes through. As shown in FIG. 3, the magnetized metal floor tab 142 may include a notification light 144. The notification light 144 is configured to remain illuminated when the one-way swinging door 120 is connected to the magnetized metal floor tab 142 and the monitored escalator barricade system 100 is actively monitoring. Additionally, the notification light 144 is not illuminated when the one-way swinging door 120 is open and disconnected from the magnetized metal floor tab 142. In a preferred embodiment, the one-way swinging door 120 includes a translucent plexiglass material. However, the door may include various materials, such as but not limited to glass, plexiglass, acrylic, and pipe. In certain embodiments, the barricade assembly 110 further includes at least one handle. In yet another alternate embodiment, the monitored escalator barricade system 100 includes sensors positioned at various points along the escalator 10. The sensors are in communication with the alarm system 160.

Figure 4:
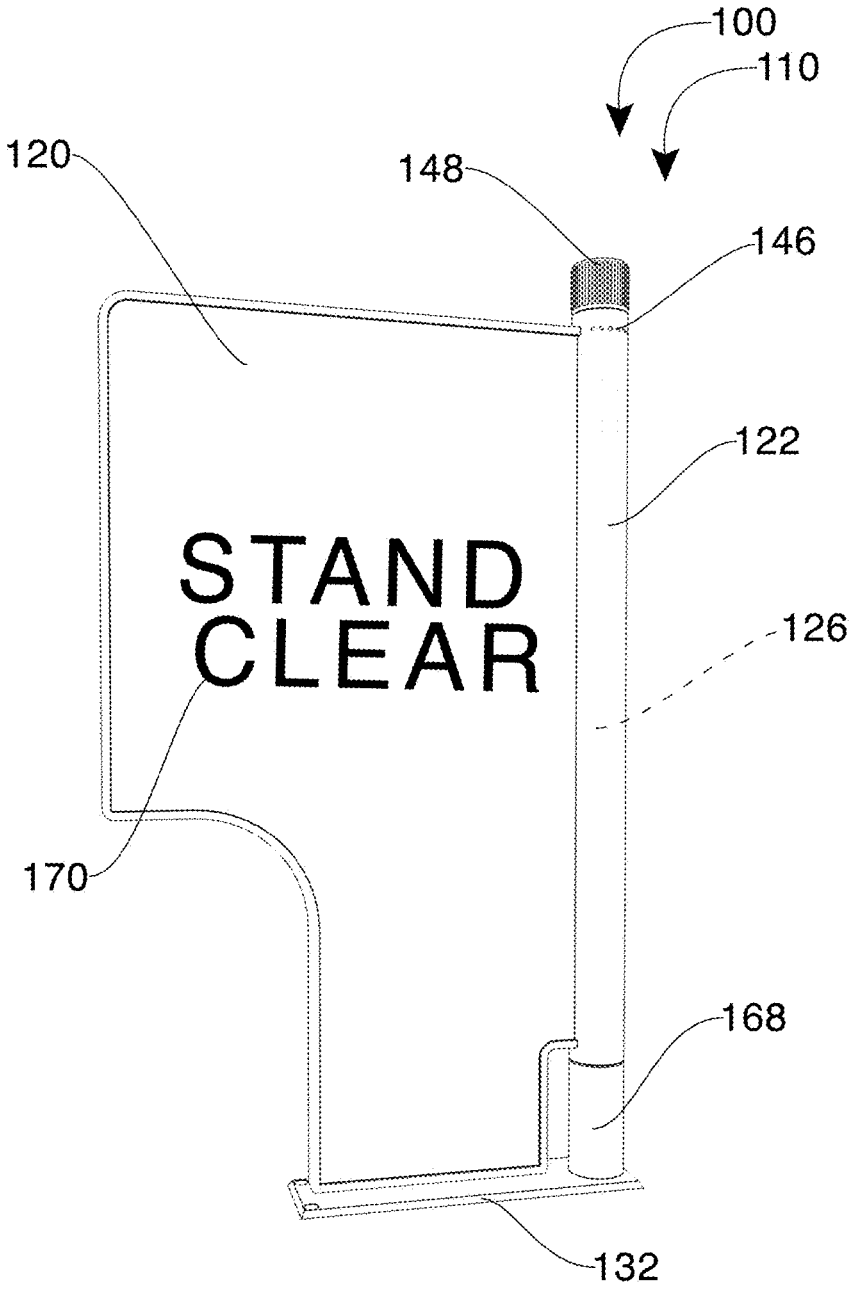
FIG. 4 is a perspective view of the barricade assembly of the monitored escalator barricade system of FIG. 1, according to an embodiment of the present disclosure.

FIG. 4 is a perspective view of the monitored escalator barricade system 100 of FIG. 1, according to an embodiment of the present disclosure. The barricade assembly 110 may further include instructional indicia 170 such as but not limited to "push" or other suitable instructions. The signage may be printed in multiple languages of relevance to its area of use. In further variation, the instructional indicia 170 may be illuminated, and such illumination may be permanent or only when the monitored escalator barricade system detects a user 20 is near the one-way swinging door 120. Additionally, the monitored escalator barricade system 100 can include instructional indicia 170 and/or warning signage for posting at the landing floor near its point of placement, such as but not limited to "area must remain clear." The signage may be printed in multiple languages of relevance to its area of use.

Figure 5:
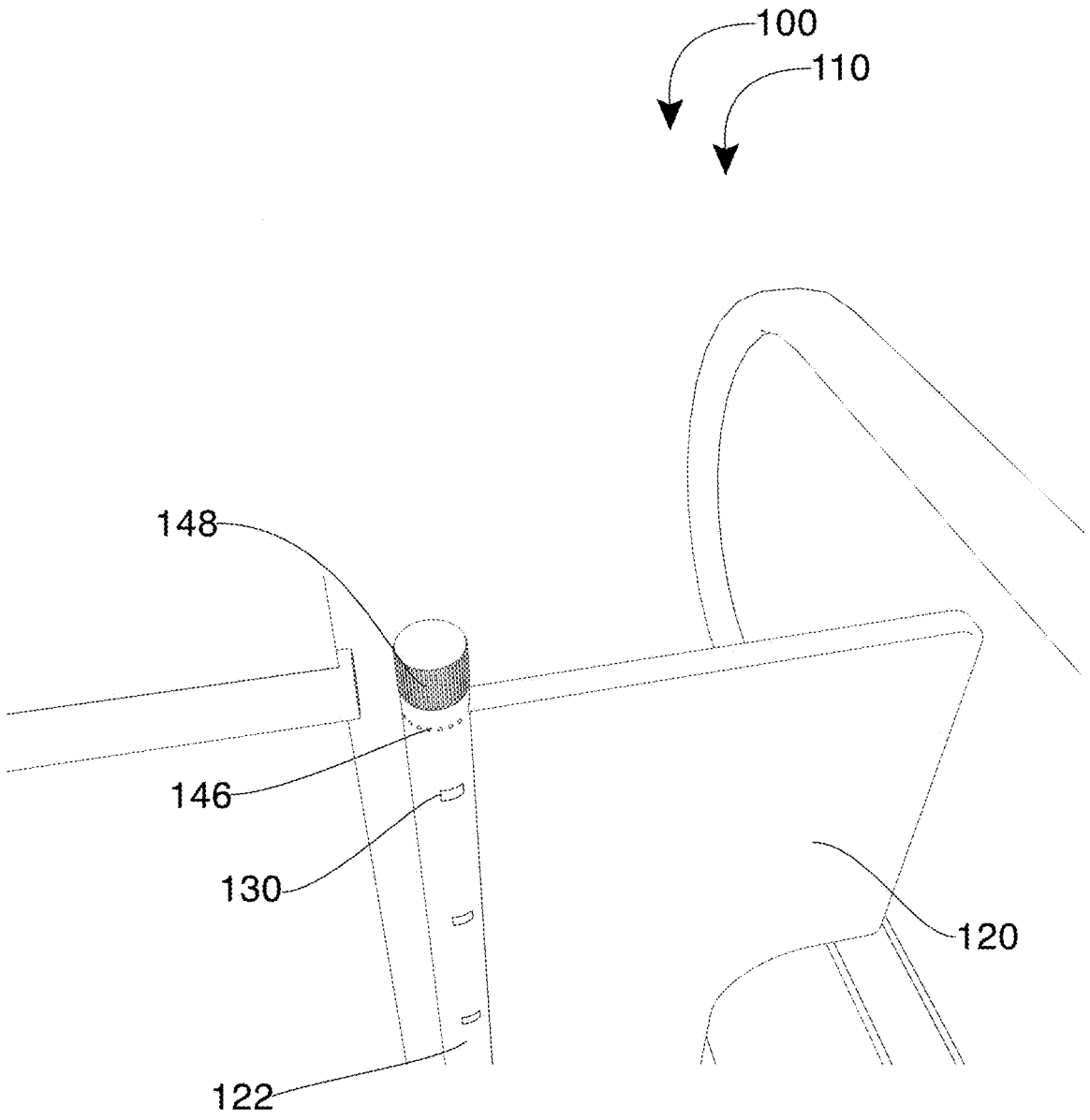
FIG. 5 is a top perspective view of the barricade assembly of the monitored escalator barricade system of FIG. 1 in an 'installed-condition', according to an embodiment of the present disclosure.

FIG. 5 is a top perspective view of the monitored escalator barricade system 100 of FIG. 1, according to an embodiment of the present disclosure. The monitored escalator barricade system comprises the barricade assembly 110 having the one-way swinging door 120 and the hosting column 122 supporting the one-way swinging door 120 and housing the transceiver 126 and including the IR beam transmitters 130 on an exterior of the hosting column 122. The monitored escalator barricade system 100 may be installed at a top outside edge of an ascending escalator 10 and provides a safety system for preventing injuries from unsafe access to an escalator 10.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A monitored escalator barricade system, the monitored escalator barricade system comprising:

a barricade assembly which is installable on a landing floor proximal to an escalator including;

a one-way swinging door allowing one-way passage of a user having a magnetized metal door-plate on an open vertical plane of the one-way swinging door;

a hosting column supporting the one-way swinging door and housing a transceiver and including infrared (IR) beam transmitters on an exterior of the hosting column configured to detect when the user arrives near the landing floor;

a magnetized metal floor tab in alignment to and magnetically contacts to the magnetized metal door-plate; and an alarm system in communication with the transceiver and configured to activate when the one-way swinging door is pushed by the user and to notify authorities; and wherein the transceiver is electrically connected to the magnetized metal door-plate and the IR beam transmitters are electrically connected by wire to the transceiver; and wherein the hosting column is supported upon a base plate, the base plate being mountable to the landing floor.

2. The monitored escalator barricade system of claim 1, wherein the one-way swinging door is attached to the hosting column via fasteners.

3. The monitored escalator barricade system of claim 2, wherein the fasteners comprise spring-loaded, self-returning hinges.

4. The monitored escalator barricade system of claim 3, wherein the spring-loaded, self-returning hinges are limited to ninety-degree rotation.

5. The monitored escalator barricade system of claim 1, wherein the alarm system includes an audio speaker configured to output audio and at least one light emitting member.

6. The monitored escalator barricade system of claim 5, wherein the audio speaker and the at least one light emitting member are contained within, and project from, the hosting column and connect by wire to the transceiver.

7. The monitored escalator barricade system of claim 5, wherein interruption of the IR beam transmitters detected by the transceiver unlocks the one-way swinging door.

8. The monitored escalator barricade system of claim 7, wherein the audio speaker of the alarm system is activated after the one-way swinging door is opened.

9. The monitored escalator barricade system of claim 1, wherein the IR beam transmitters are equidistantly spaced along a length of the exterior of the hosting column.

10. The monitored escalator barricade system of claim 1, wherein the alarm system is able to sync with a security-officer-notification system of a using establishment.

11. The monitored escalator barricade system of claim 1, wherein the magnetized metal floor tab includes a notification light.

12. The monitored escalator barricade system of claim 11, wherein the notification light is configured to remain illuminated when the one-way swinging door is connected to the magnetized metal floor tab and the monitored escalator barricade system is actively monitoring.

13. The monitored escalator barricade system of claim 12, wherein the notification light is not illuminated when the one-way swinging door is open and disconnected from the magnetized metal floor tab.

14. The monitored escalator barricade system of claim 1, wherein magnetic contact between the magnetized metal door-plate and the magnetized metal floor tab provide a locking mechanism.

15. The monitored escalator barricade system of claim 1, wherein the one-way swinging door automatically returns to a closed position after the user passes through.

16. The monitored escalator barricade system of claim 1, wherein the barricade assembly further includes instructional indicia.

17. The monitored escalator barricade system of claim 1, wherein the one-way swinging door comprises a transparent material.

18. The monitored escalator barricade system of claim 17, wherein the transparent material is plexiglass.

19. The monitored escalator barricade system of claim 1, wherein a material of the one-way swinging door is selected from the group consisting of glass, plexiglass, acrylic, and pipe.

20. A monitored escalator barricade system, the monitored escalator barricade system comprising:

a barricade assembly which is installable on a landing floor proximal to an escalator including;

a one-way swinging door allowing one-way passage of a user having a magnetized metal door-plate on an open vertical plane of the one-way swinging door;

a hosting column supporting the one-way swinging door and housing a transceiver and including infrared (IR) beam transmitters on an exterior of the hosting column configured to detect when the user arrives near the landing floor;

a magnetized metal floor tab in alignment to and magnetically contacts to the magnetized metal door-plate;

an alarm system in communication with the transceiver and configured to activate when the one-way swinging door is pushed by the user and to notify authorities; and wherein the hosting column is supported upon a base plate, the base plate being mountable to the landing floor;

wherein the transceiver is electrically connected to the magnetized metal door-plate and the IR beam transmitters are electrically connected by wire to the transceiver;

wherein the one-way swinging door is attached to the hosting column via fasteners;

wherein the fasteners comprise spring-loaded, self-returning hinges;

wherein the spring-loaded, self-returning hinges are limited to ninety-degree rotation;

wherein the one-way swinging door automatically returns to a closed position after the user passes through;

wherein the alarm system includes an audio speaker configured to output audio and at least one light emitting member;

wherein the audio speaker and the at least one light emitting member are contained within, and project from, the hosting column and connect by wire to the transceiver;

wherein interruption of the IR beam transmitters detected by the transceiver unlocks the one-way swinging door;

wherein the audio speaker of the alarm system is activated after the one-way swinging door is opened;

wherein the IR beam transmitters are equidistantly spaced along a length of the exterior of the hosting column;

wherein the hosting column is supported upon a base plate;

wherein magnetic contact between the magnetized metal door-plate and the magnetized metal floor tab provide a locking mechanism;

wherein the magnetized metal floor tab includes a notification light;

wherein the notification light is configured to remain illuminated when the one-way swinging door is connected to the magnetized metal floor tab and the monitored escalator barricade system is actively monitoring;

wherein the notification light is not illuminated when the one-way swinging door is open and disconnected from the magnetized metal floor tab;

wherein the alarm system is able to sync with a security-officer-notification system of a using establishment;

wherein the one-way swinging door comprises a transparent material; and wherein the transparent material is plexiglass.

* * * * *